United States Patent [19]

McAusland

[11] Patent Number: 4,773,140

[45] Date of Patent: Sep. 27, 1988

[54] PHASED ARRAY TRANSDUCER CONSTRUCTION

[75] Inventor: Robert R. McAusland, Seattle, Wash.

[73] Assignee: Advanced Technology Laboratories, Inc., Bellevue, Wash.

[21] Appl. No.: 547,150

[22] Filed: Oct. 31, 1983

[51] Int. Cl.[4] ..... H04R 17/00

[52] U.S. Cl. ..... 29/25.35; 310/334

[58] Field of Search ..... 29/25.35; 310/334, 345, 310/348

[56] References Cited

U.S. PATENT DOCUMENTS 3,952,387 4/1976 Iinuma et al. ..... 310/334

4,385,255 5/1983 Yamaguchi et al. ..... 310/348

*Primary Examiner*—P. W. Echols

*Attorney, Agent, or Firm*—Christensen, O'Connor, Johnson & Kindness

[57] ABSTRACT

A method of manufacturing a phased array ultrasound transducer, and the transducer manufactured by the inventive method are described. In the method, a piezoelectric crystal is soldered to the edges of a pair of double sided printed circuit boards, each of which has traces on either side. Then, a backing material is poured to secure the crystal and boards, and a saw is used to define the elements of the transducer.

1 Claim, 1 Drawing Sheet

PHASED ARRAY TRANSDUCER CONSTRUCTION

BACKGROUND OF THE INVENTION

The present invention relates to a method of constructing phased array ultrasound transducers of the type used for medical imaging and to medical ultrasound transducers produced by the inventive method.

As is well known in the medical ultrasound imaging art, there are various types of ultrasound scanners. These include mechanical scanners, such as rotating and oscillating scanners, and electronic scanners, such as linear array transducers, and phased array transducers. Ultrasound transducers are typically comprised of a piezoelectric material, such as a lead-zirconate-titanate (PZT) crystal, which is made to oscillate by the imposition of a signal. Phased array transducers are typically comprised of a small bar of a piezoelectric material which is cut into a number of elements which are pulsed in sequence, with appropriate delays, whereby they send out electronically steered waves of ultrasound energy. Typically, phased array transducers are quite small dimensionally. Accordingly, they are very difficult to construct, and a major portion of the expense associated with manufacturing a phased array scanhead is associated with the labor required to construct the scanhead.

An additional expense associated with the manufacture of phased array transducers is that they require separate signal handling channels for each of the elements in the array. In view of the fact that each channel requires a number of components, and the further fact that a phased array transducer often includes at least 32 channels, the expense of producing the electronics for each channel is large. Accordingly, it is quite expensive to manufacture a phased array scanhead and then to find, after manufacture, that it is inoperative for some reason.

SUMMARY OF THE INVENTION

In accordance with the present invention, a method for manufacturing a phased array ultrasound scanhead is described. In accordance with the method, a simplified process for manufacturing a phased array scanhead is described in which the phased array transducer, when manufactured, includes edge connectors which form an integral part of the phased array transducer. When the transducer is manufactured in accordance with the present method, it is insertable into an edge connector on a board containing the electronics for the scanhead. Accordingly, after manufacture, the phased array transducer can be tested separately from its associated electronics. Thus, only operational units are encapsulated, so if there is a defective transducer, it may be replaced by an operational unit prior to encapsulation and further testing. Therefore, there is no expense associated with electronics connected to transducers which are inoperative as manufactured.

In accordance with the inventive method of manufacturing a phased array ultrasound transducer, a piezoelectric crystal is soldered to the edges of a pair of double sided printed circuit boards, each of which has traces on either side. Then, a backing material is poured to secure the crystal and boards, and a saw is used to define the elements of the transducer.

DETAILED DESCRIPTION OF THE PREFERRED EMBODIMENT

Figure 1:
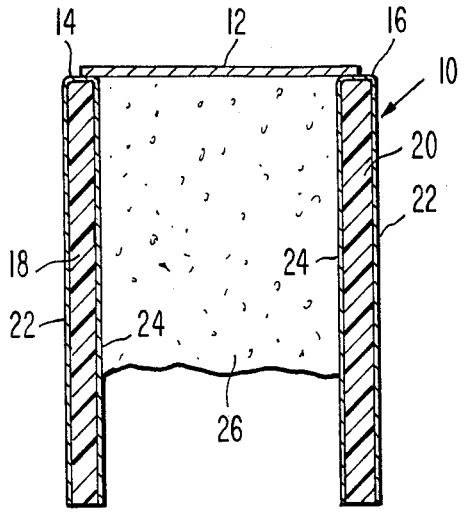
FIG. 1 is a cross-sectional front view of a transducer manufactured in accordance with the present invention.

Referring to FIG. 1, a front view of a phased array transducer 10, manufactured in accordance with the present invention, is shown. The transducer 10 is comprised of a piezoelectric crystal 12 which has been reflow soldered onto the top edges 14, 16 of a pair of double-sided printed circuit boards 18, 20, each having an outside surface 22 and an inside surface 24. As used herein, the terms "outside" surface 22 and "inside" surface 24 refer to whether the surface is exposed to a backing material 26 (an "inside" surface) or not (an "outside" surface). The backing material 26 is a nonconductive materal, typically a tungsten oxide epoxy, which can be poured into the space between the inside surfaces 24 of the circuit boards 18, 20 and the back of the piezoelectric crystal 12 which form a mold for pouring the backing material. Prior to soldering, the crystal 12 is metalized on both sides.

Figure 2:
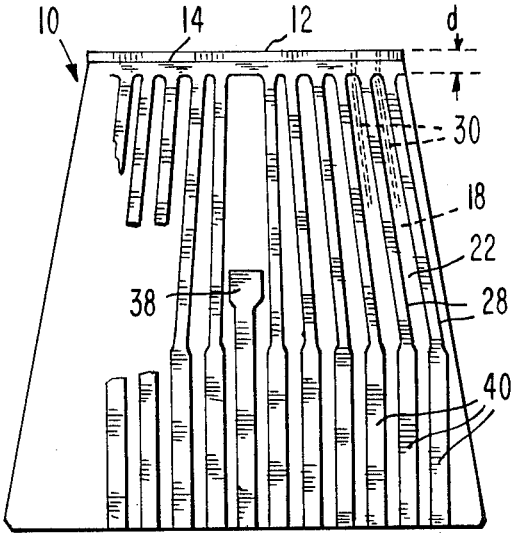
FIG. 2 is a side view of the transducer of FIG. 1.

Referring now to FIG. 2, a side view of the outside surface 22 of the circuit board 18 with the phased array transducer 10 thereon is shown. There are a series of traces 28 printed on the outside surface 22 of the circuit board 18. Similarly, there are a series of traces 30 (shown in the shadow) on the inside surface 24 of the circuit board 18. The pitch of the traces 28, 30 is selected so that adjacent the top edge 14 the pitch is about one-fourth the desired element pitch of the completed phased array transducer 10.

Figure 3:
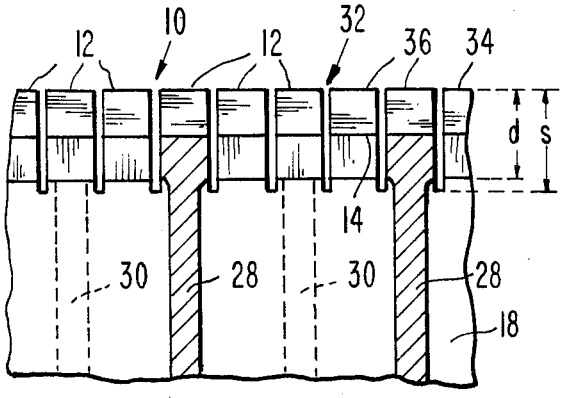
FIG. 3 is an exploded view of a portion of FIG. 2.

Referring now to FIGS. 2–5, after the piezoelectric crystal 12 has been reflow soldered onto the top surfaces 14, 16 of the circuit boards 18, 20, which, incidently, are identical in the preferred embodiment of the invention, and the backing material 26 has been poured into place and cured, the transducer 10 is placed into a jig under a cutting implement capable of making very small, well defined cuts, such as a semiconducter dicing saw. The piezoelectric crystal 12 is then aligned (using mirrors to look at the traces 28 on the outside surfaces 22) so that a cut, leaving a saw kerf 32, is made between the traces 28, 30 on each of the boards 18, 20. The saw kerf 32 defines an element 34 of the transducer 10 by electrically separating a portion of the crystal 12 from the rest of the crystal 12 thereby forming the array element 34. The saw kerf 32 also separates that element 34 from the remaining portions of the crystal 12 which are contacted by other traces 28, 30. As shown in FIG. 3, the saw kerf 32 cuts through the top surface 36 of the crystal 12 to a depth, s, which must be greater than the depth, d, of the piezoelectric crystal 12 plus the depth to which the traces 28, 30 overlap the ends 14, 16 of the boards 18, 20. Thus, the saw kerf 32 provides complete electrical isolation of each element 34 from the other elements 34 into which the crystal 12 is cut. In the preferred embodiment of the invention, the depth, s, is about 32 mils.

Figure 4:
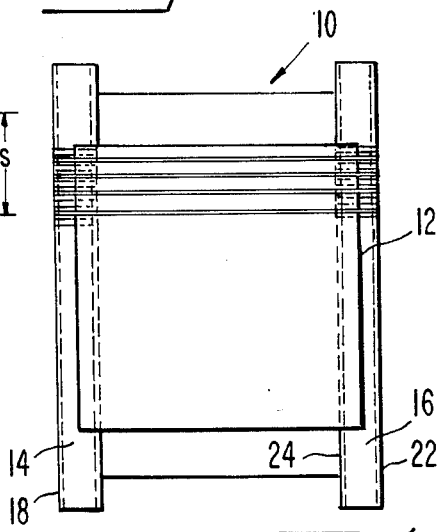
FIG. 4 is a top view of the transducer manufactured in accordance with the present invention.
Figure 5:
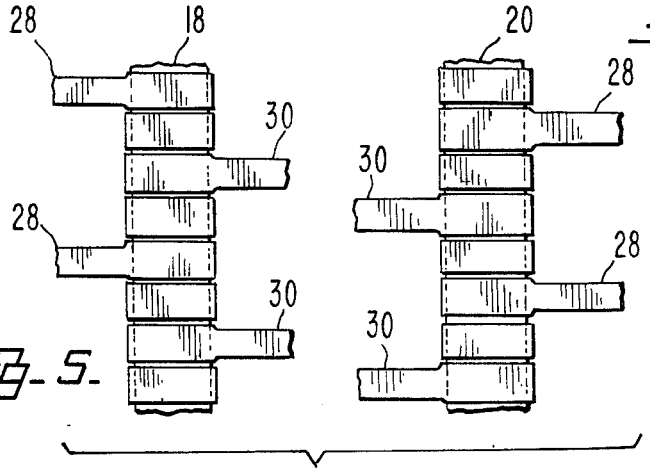
FIG. 5 is an exploded view of a portion of FIG. 4 in which the traces have been tilted out of their plane in order that they may be seen from the top.

The saw kerf 32 angles slightly, as shown in FIG. 4, so that each element 34 of the transducer 12 is contacted by only a single one of the traces 28, 30 from only a single one of the boards 18, 20. Thus, the density of the elements 34 of the crystal 12 is four times the pitch of the traces 28, 30. Note that in FIG. 5, the traces 28, 30 are illustrated in order to show their orientation with respect to the elements 34. Actually, the traces 28, 30 would not appear in a true illustration of the top of the transducer 10, but FIG. 5 is meant to illustrate the orientation of the traces with respect to the elements 34, rather than a true top view.

After the first saw kerf 32 has been made, the transducer 10, in the jig, is moved over by the width of one element 34 and a parallel saw kerf 32 is made in order to electrically isolate the next adjacent element 34. This process is repeated until the crystal 12 has been fully defined into a series of elements 34 corresponding in number to the number of elements 34 in the completed transducer 10 as shown in FIG. 4. In the preferred embodiment of the invention, the saw kerfs 32 are about 2 mils wide and are formed on 11 mil centers.

After defining the elements 34 of the transducer 10, it is necessary to form an electrical contact to their top surfaces 36. In the preferred embodiment of the invention, the contact to the top surface 36 is made by using a flexible printed circuit board (not shown) which is soldered to the tops of the elements 34 and then soldered to ground traces 38 on the outside surfaces 22 of the boards 18, 20, thereby completing the transducer 10. As will be recognized by those skilled in the art, in order to prevent shorting the traces 30, the contact portion of the printed circuit board must either have a configuration which does not contact the traces 30, or, alternatively, the exposed portions of the traces 30 must be electrically insulated. As will be recognized, however, other methods of making electrical contact to the top surfaces 36 of the elements 34 can be used without departing from the present inventive concept. One such alternative method would be by ultrasonically bonding wires to the top surfaces 36. However, other methods could also be used.

I claim:

1. The method of manufacturing a phased array ultrasound transducer of the type comprising a bar of piezoelectric material which has been separated into a series of parallel elements comprising the steps of:

(a) metalizing both sides of a bar of piezoelectric material;

(b) providing a pair of double sided printed circuit boards, each having a series of traces formed thereon, said traces each having a pitch which is substantially one-fourth the pitch of elements desired on said phased array ultrasound transducer, said traces overlapping the top edge of each of said boards;

(c) soldering said bar of piezoelectric material onto said top edges of said boards;

(d) pouring a nonconductive backing material into the space between said boards, said backing material being selected to bond to said boards and to said bar of piezoelectric material, whereby mechanical integrity of the structure is provided;

(e) defining said elements of said array by cutting through said bar of piezoelectric material and through the portion of said traces which extends over said top edges of said board, whereby a series of electrically isolated elements, each contacted by only one of said traces is formed; and (f) forming an electrical contact to the tops of said elements.

* * * * *